US006264718B1

(12) United States Patent
Akagi et al.

(10) Patent No.: US 6,264,718 B1
(45) Date of Patent: Jul. 24, 2001

(54) POWDER METALLURGY PRODUCT AND METHOD FOR MANUFACTURING THE SAME

(75) Inventors: Nobuaki Akagi; Shinya Kawai; Michael E. Lutheran, all of Seymour, IN (US); Masaaki Satoh; Hironori Suzuki, both of Takasago (JP)

(73) Assignees: Kobelco Metal Powder of America, Inc., Seymour, IN (US); Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/580,926

(22) Filed: May 26, 2000

(51) Int. Cl.[7] ..... B22F 3/00

(52) U.S. Cl. ..... 75/246; 75/231; 419/10; 419/31

(58) Field of Search ..... 75/246, 231; 419/31, 419/10

(56) References Cited

U.S. PATENT DOCUMENTS 5,501,728 * 3/1996 Shepley et al. ..... 106/36
5,534,220 * 7/1996 Purnell et al. ..... 419/45
5,571,305 * 11/1996 Uenosono et al. ..... 75/246
5,631,431 * 5/1997 Andersson ..... 75/230
5,679,909 * 10/1997 Kaneko et al. ..... 75/246
5,938,814 * 8/1999 Uenosono et al. ..... 75/254

* cited by examiner

*Primary Examiner*—Ngoclan Mai
(74) *Attorney, Agent, or Firm*—Oblon, Spivak, McClelland, Maier & Neustadt, P.C.

(57) ABSTRACT

A powder metallurgy product which is made from constituent including iron powder. The iron powder includes iron grains which contain machinability improving element in the iron grains. The machinability improving element is configured to improve machinability of the powder metallurgy product and has a pinning effect. An amount (Q) of the machinability improving element is adjusted such that an absolute value of a differential coefficient (dS/dQ) is at least a predetermined value, where (S) is a grain size of iron in the powder metallurgy product.

23 Claims, 2 Drawing Sheets

POWDER METALLURGY PRODUCT AND METHOD FOR MANUFACTURING THE SAME

BACKGROUND OF THE INVENTION

1. Field of the Invention

The present invention relates to a powder metallurgy product and a method for producing the powder metallurgy product.

2. Description of the Background

In powder metallurgy, after some kinds of powders are mixed at a predetermined ratio, the mixed powder is formed into a desired shape under pressure and then sintered to be a final metallurgy product.

One of the advantages of powder metallurgy products is that machining operation is not necessary because powder metallurgy products having a substantially final shape may be formed in dies without machining operation. Recently, higher precision and more complex shapes have been required. Accordingly, machining operations have been required even for powder metallurgy products. However, generally, powder metallurgy products have poor machinability.

Japanese Examined Patent Publication (kokoku) 56-45964 (hereinafter referred to as the "'964 publication") discloses steel powder having good machinability. The contents of this application are incorporated herein by reference in their entirety.

In the steel powder disclosed in the '964 publication, the steel powder contains S of 0.15 to 0.5 weight percent (wt %) and Mn of at most an amount greater than a Mn/S balance amount by 0.3 weight percent. Mn is used for combining with S. MnS is not easily oxidized after Mn combines with S.

Generally, powder metallurgy products have inferior mechanical strength. The reason is presumed that powder metallurgy products have many pores therein, because powder metallurgy products are produced by being formed under pressure and being sintered.

SUMMARY OF THE INVENTION

An object of the present invention is to provide a powder metallurgy product which has improved machinability without substantially deteriorating fatigue strength.

According to one aspect of the invention, a powder metallurgy product is made from constituent including iron powder. The iron powder includes iron grains which contain machinability improving element in the iron grains. The machinability improving element is configured to improve machinability of the powder metallurgy product and has a pinning effect. An amount (Q) of the machinability improving element is adjusted such that an absolute value of a differential coefficient (dS/dQ) is at least a predetermined value, where (S) is a grain size of iron in the powder metallurgy product.

According to another aspect of the invention, a method for producing a powder metallurgy product includes adding machinability improving element to iron grains of iron powder so as to contain machinability improving element in the iron grains; forming the iron powder to a pre-product under pressure; and sintering the pre-product. The machinability improving element is configured to improve machinability of the powder metallurgy product and has a pinning effect. An amount (Q) of the machinability improving element is adjusted such that an absolute value of a differential coefficient (dS/dQ) is at least a predetermined value, where (S) is a grain size of iron in the powder metallurgy product.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DESCRIPTION OF THE PREFERRED EMBODIMENTS

The preferred embodiments will now be described with reference to the accompanying drawings.

In powder metallurgy, after some elements are added to and mixed with iron powder, the mixed powder is formed under pressure to a pre-product having a desired shape and then the pre-product is sintered to be a final metallurgy product. In the present embodiment according to the present invention, a machinability improving element to improve machinability of a powder metallurgy product is substantially uniformly contained in iron grains of iron powder in order to improve the machinability of the powder metallurgy product. As the machinability improving element, for example, element which has a machinability improving effect and a pinning effect may be used. Further, the machinability improving element is, for example, metallurgically deposited material (inclusion) or a material which has melting point higher than that of iron. For example, oxide of Al, Si, Mg, Mn, or Ca may be used. CaO, $SiO_2$ may be used. $2CaO—Al_2O_3—SiO_2$ may be used. Further, MnS, BN or the like may be used. Ceramic powder having melting point higher than that of iron may also be used. In the present embodiment, MnS is used. Further, in addition to MnS, elements for improving mechanical strength of powder metallurgy products, for example, Ni or Mo may be contained in iron particles. Ni or Mo may be simply mixed with iron powder. Further, Ni or Mo may be combined with iron particles by diffusion bonding.

First, fatigue strength and machinability were compared among three samples of powder metallurgy products. The three samples A, B and C are as follows:

Sample A: Base material is pure iron powder. MnS is not included.

Sample B: Base material is pure iron powder. MnS is added to and mixed with the iron powder.

Sample C: Base material is pre-alloyed iron powder which contains MnS inside iron grains.

TABLE 1

| Sample | Base Material | MnS | Cu | Gr | Lub |
|---|---|---|---|---|---|
| A | Pure Iron | — | 2.00 | 0.60 | 0.75 |
| B | Pure Iron | 0.30 | 2.00 | 0.60 | 0.75 |
| C | Pre-alloyed Iron | * | 2.00 | 0.60 | 0.75 |

*MnS is contained in iron grains of pre-alloyed iron powder.

TABLE 2

| | C | Si | Mn | P | S | O |
|---|---|---|---|---|---|---|
| Pure Iron | 0.001 | 0.01 | 0.20 | 0.012 | 0.010 | 0.16 |
| Pre-alloyed Iron | 0.002 | 0.01 | 0.56 * | 0.032 | 0.300 * | 0.23 |

*A part of Mn and S exists as MnS of about 0.7 wt %.

Figure 1:
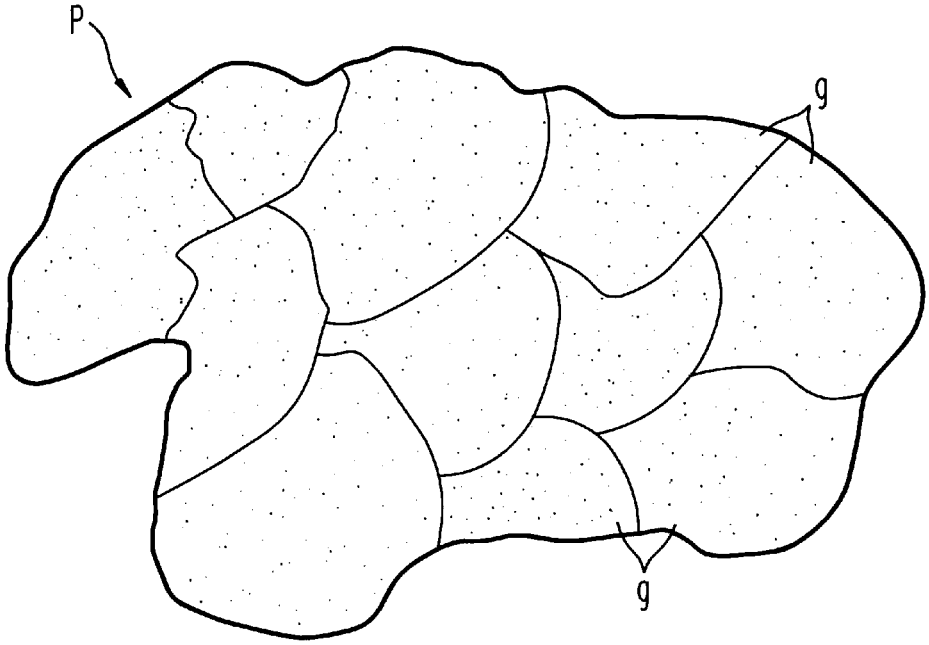
FIG. 1 is an enlarged cross sectional view of a particle (P) of 400MS-A grade powder.

Table 1 shows specific compositions by weight percent (wt %) of the three samples A, B and C. Table 2 shows specific compositions by weight percent (wt %) of pure iron and pre-alloyed iron. An example of the pure iron powder is 300M grade manufactured by KOBE STEEL, LTD. An example of the pre-alloyed iron powder is 400MS-A grade manufactured by KOBE STEEL, LTD. The 400MS-A grade powder contains MnS particles inside each powder particle uniformly. In the production process of the pre-alloyed iron, manganese and sulfur are added into molten steel during conventional melting and refining processes. Then, iron powder is produced according to the conventional procedure. FIG. 1 shows an enlarged cross sectional view of one particle (P) of the 400MS-A grade powder. The particle (P) was etched by nital to be able to observe grain boundaries. MnS particles are substantially uniformly deposited all over the iron particle. The iron powder includes a lot of iron particles. In the pre-alloyed iron powder, referring to FIG. 1, one iron particle (P) includes plural iron grains (g). MnS which is shown by dot is substantially uniformly deposited in the iron grains (g).

Copper powder is screened by 150 Mesh (105 $\mu$m) and 90% of copper powder is pass through 200 Mesh (75 $\mu$m). Graphite (Gr) powder has 9.1 $\mu$m of D50 and 20.9 $\mu$m of D90. Lubricant (Lub) is selected from pure wax grade. MnS powder has 8.5 $\mu$m of D50 and 32.4 $\mu$m of D90. Mixtures are typical Fe—Cu—C composition. The mixture B contains MnS powder which is simply mixed with iron powder. The mixture A does not have MnS. The mixture C contains MnS particle inside the iron grains.

All mixtures A, B and C were formed to sample products which have a 90 mm outer diameter and a 45 mm height by using a uni-axis hydraulic press with 588 Mpa. The density of the sample products were 7.04 $Mg/m^3$ (sample A), 7.02 $Mg/m^3$ (sample B) and 6.96 $Mg/M^3$ (sample C), respectively. These sample products were sintered at 1140° C. (2084° F.) during 40 minutes in a pusher type sintering furnace under pure nitrogen atmosphere. Sintered density were 6.98 $Mg/M^3$ (sample A), 6.96 $Mg/m^3$ (sample B) and 6.86 $Mg/M^3$ (sample C), respectively.

Before pre-heating these samples for forging, graphite lubricant was coated on the surface of the sintered material to reduce frictions between sintered material and forging die wall and to prevent oxidation (or decarburization). Sintered materials are pre-heated at 1050° C. (1922° F.) during 30 minutes in a pre-heating furnace for forging. Forging was carried out with pressure of 980 MPa using a 1600 ton mechanical forging press.

(1) Fatigue Strength 1 type rotating bending fatigue test specimens according to JIS (Japanese Industrial Standard) Z 2274 of 1974 were prepared for measuring fatigue strength. The contents of JIS Z 2274 of 1974 are incorporated herein by reference in their entirety. Fatigue strength was measured according to Ono rotating bending fatigue method. The rotational speed was 3,600 rpm. Fatigue limit was defined as $10^7$ cycles.

(2) Machinability

Machinability was determined by thrust force, i.e., cutting resistance during drilling. Reduction of the thrust force means improvement of machinability. Drilling conditions are as follows:

Drill: High speed steel drill having 5 mm diameter,

Speed: 800 rpm,

Depth of a drilling hole: 10 mm,

Feed rate: 0.05 mm/rev, and

Lubrication: No lubrication.

TABLE 3

| Sample | Fatigue Strength ($N/mm^2$) | Thrust Force (kgf) |
|---|---|---|
| A | 343 | 90.0 |
| B | 333 | 71.0 |
| C | 343 | 55.8 |

Referring to Table 3, in sample B, thrust force may reduce by 19 kgf comparing to that of sample A. Namely, machinability may improve. However, fatigue strength reduced by 10 $N/mm^2$. Namely, the simple mixture of MnS and iron powder may improve machinability, but deteriorates fatigue strength.

On the other hand, in sample C, thrust force may reduce by 34.2 kgf comparing to that of sample A, while fatigue strength is same as that of sample A. Namely, pre-alloyed iron powder which contains MnS inside iron grains may improve machinability without substantially deteriorating mechanical strength.

In sample C, the reason why fatigue strength does not deteriorate cannot be explained by the theory that iron particles which includes plural iron grains firmly combine with each other because brittle elements, i.e., MnS, does not exist on iron particle boundaries. It is not reasonable to presume that powder metallurgy products which are formed from pre-alloyed iron powder which contains MnS of 0.7 wt % inside iron grains have substantially the same strength as that of powder metallurgy product (sample A) which are formed from pure iron powder. Accordingly, the inventors paid attention to the grain size of iron of the powder metallurgy products. The inventors measured the grain sizes of the powder metallurgy products of the samples A and C according to "Methods of Ferrite Grain Size Test for Steel" of JIS (Japanese Industrial Standard) G 0552 of 1977. According to JIS G 0552 of 1977, grain size is defined as follows:

(1) Grain Size Grain size shall be the size of ferrite crystal grain of steel, expressed in grain size number.

(2) Grain size Number The grain size number shall be the number expressed in accordance with either the method (a) or (b) undermentioned after the grain size has been measured by the method specified as under.

(a) Table 4 shall apply to the expression of grain size number when the measurement is made by comparison method.

TABLE 4

| Grain Size Number | | | |
|---|---|---|---|
| Grain size No. (N) | Number of crystal grain per $mm^2$ of sectional area | Mean sectional area of crystal grain $mm^2$ | Mean number of crystal grain in 25 $mm^2$ at 100 magnification (n) |
| −3 | 1 | 1 | 0.0625 |
| −2 | 2 | 0.5 | 0.125 |
| −1 | 4 | 0.25 | 0.25 |
| 0 | 8 | 0.125 | 0.5 |
| 1 | 16 | 0.0625 | 1 |

TABLE 4-continued

| Grain size No. (N) | Number of crystal grain per mm² of sectional area | Mean sectional area of crystal grain mm² | Mean number of crystal grain in 25 mm² at 100 magnification (n) |
|---|---|---|---|
| | Grain Size Number | | |
| 2 | 32 | 0.0312 | 2 |
| 3 | 64 | 0.0156 | 4 |
| 4 | 128 | 0.00781 | 8 |
| 5 | 256 | 0.00390 | 16 |
| 6 | 512 | 0.00195 | 32 |
| 7 | 1024 | 0.00098 | 64 |
| 8 | 2048 | 0.00049 | 128 |
| 9 | 4096 | 0.000244 | 256 |
| 10 | 8192 | 0.000122 | 512 |

b) In measurements made by intercept method, the following formula shall apply to the expression of grain size number.

The grain size number shall be rounded off to the first decimal place.

$$n = 500\left(\frac{M}{100}\right)^2\left(\frac{l_1 \times l_2}{L_1 \times L_2}\right) \tag{1}$$

$$N = \frac{\log n}{0.301} + 1$$

Where N: grain size number n: number of grain size in 25 mm² under a microscope of 100 magnification M: microscope magnification $L_1$ (or $L_2$) total length (in mm) of one linear length of the segments orthogonally crossing each other $l_1$ (or $l_2$): total number of crystal grain intercepted by $L_1$ (or $L_2$)

The contents of JIS G 0552 of 1977 are incorporated herein by reference in their entirety. The number of crystal grains per 1 mm² increases as the grain size number increases. Accordingly, the grain size decreases as the grain size number increases.

TABLE 5

| | Sample A | Sample C |
|---|---|---|
| Grain Size No. | 6.2 | 7.5 |

Referring to Table 5, in the sample C, i.e., in the powder metallurgy product which is formed from pre-alloyed iron powder which contain MnS in iron grains, the grain size is smaller than that of the sample A, i.e., the powder metallurgy product which is formed from pure iron powder. When observing the metallograph of the powder metallurgy product of sample C, many MnS particles exist on the grain boundary of iron. Accordingly, it is presumed that MnS particles operate as pinning points and thus inhibit the growth of iron grains.

TABLE 6

| | Powder MnS (%) | Compact GD (g/cc) | Forged Properties: Fatigue Strength (N/mm²) | Thrust Force (kgf) | Grain Size Number (JIS G 0552) |
|---|---|---|---|---|---|
| Comp. Examp. 1 | 0.00 | 6.85 | 344 | 90 | 6.2 |
| Comp. Examp. 2 | 0.05 | 6.83 | 344 | 84 | 6.3 |
| Example 1 | 0.10 | 6.80 | 348 | 76 | 6.5 |
| Example 2 | 0.26 | 6.79 | 343 | 69 | 6.8 |
| Example 3 | 0.54 | 6.78 | 345 | 63 | 7.2 |
| Example 4 | 0.80 | 6.76 | 344 | 56 | 7.5 |
| Example 5 | 0.98 | 6.75 | 347 | 53 | 7.5 |
| Example 6 | 1.29 | 6.74 | 345 | 49 | 7.6 |
| Comp. Examp. 3 | 1.68 | 6.72 | 338 | 46 | 7.6 |
| Comp. Examp. 4 | 2.02 | 6.69 | 336 | 44 | 7.8 |
| Comp. Examp. 5 | 2.38 | 6.65 | 330 | 43 | 7.8 |
| Comp. Examp. 6 | 2.66 | 6.63 | 328 | 42 | 7.9 |
| Comp. Examp. 7 | 2.97 | 6.62 | 321 | 43 | 7.9 |
| Comp. Examp. 8 | 3.12 | 6.58 | 318 | 40 | 7.9 |

To study the relationships between machinability or fatigue strength and an amount of MnS which is contained in iron grains, machinability, fatigue strength and grain size of iron powder metallurgy products which contain different amount (wt %) of MnS were measured. Base material of Comparative Example 1 was pure iron powder as shown in Table 2. Base materials of Examples 1–6 and Comparative Examples 2–8 were pre-alloyed iron powder as shown in Table 2 except for an amount of MnS. In each of Examples 1–6 and Comparative Examples 1–8, Cu of 2.00 wt %, Gr of 0.60 wt % and Lub of 0.75 wt % were added to the base material. Other conditions of this examination are same as those of the previous examination described before.

Figure 2:
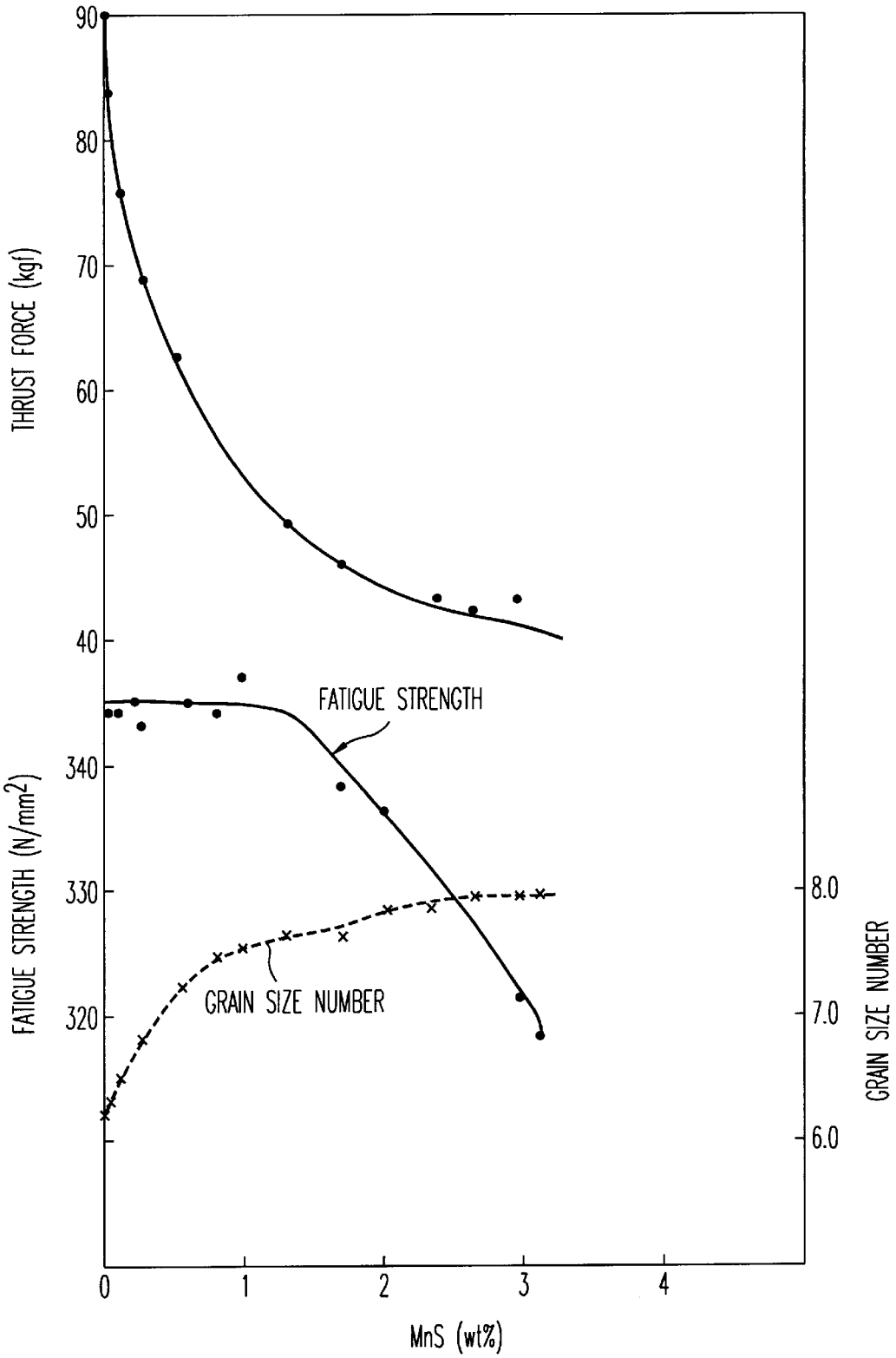
FIG. 2 illustrates a relationships between machinability, fatigue strength, or iron grain size and an amount of MnS which is contained in iron grains.

Referring to FIG. 2 and Table 6, thrust force which is cutting resistance force decreases as the amount of MnS which is contained inside iron grains increases. Namely, machinability improves as the amount of MnS which is deposited inside iron grains increases. However, generally, fatigue strength reduces as the amount of MnS which is contained inside iron grains increases. In the present invention, the inventors discovered that machinability improving element, for example, MnS exhibits a pinning effect and prevents the growth of iron grains in the powder metallurgy products because MnS particles operate as pinning points. Accordingly, within a limited amount of MnS, a powder metallurgy product having improved machinability without substantially deteriorating fatigue strength may be obtained. Referring to FIG. 2, machinability substantially improves when the iron powder contains MnS of at least about 0.1 (wt %). Further, the fatigue strength does not substantially deteriorate when the iron powder contains MnS of at most about 1.4 (wt %). Accordingly, when the iron powder contains MnS of at least about 0.1 (wt %) and at most about 1.4 (wt %), a powder metallurgy product having improved machinability without substantially deteriorating fatigue strength may be obtained. Preferably, the iron powder contains MnS of about 0.1 weight percent to about 1.0 weight percent.

Further, the inventors discovered that fatigue strength of a powder metallurgy product improves as the grain size of the powder metallurgy product reduces. Accordingly, whether the fatigue strength deteriorates depends on the balance between an strengthening effect by reducing the grain size of iron as increasing the MnS amount and the weakening effect by increasing the MnS amount. Therefore, the inventors consider a differential coefficient (dS/dQ) as an indicator of the fatigue strength, where (S) is the grain size of iron grain and (Q) is an amount of MnS. Thus, the absolute value of the differential coefficient (dS/dQ) is determined at least a predetermined value.

For example, when the grain size is defined by the grain size number according to the "Methods of Ferrite Grain Size Test for Steel" of JIS G 0552 of 1977, the predetermined value is determined as follows.

TABLE 7

| MnS (%) | dS/dQ |
|---|---|
| 0.0 | 2.160 |
| 0.1 | 1.957 |
| 0.2 | 1.764 |
| 0.3 | 1.581 |
| 0.4 | 1.408 |
| 0.5 | 1.246 |
| 0.6 | 1.093 |
| 0.7 | 0.951 |
| 0.8 | 0.818 |
| 0.9 | 0.696 |
| 1.0 | 0.584 |
| 1.1 | 0.481 |
| 1.2 | 0.389 |
| 1.3 | 0.307 |
| 1.4 | 0.235 |
| 1.5 | 0.173 |
| 1.6 | 0.121 |
| 1.7 | 0.080 |
| 1.8 | 0.048 |
| 1.9 | 0.026 |
| 2.0 | 0.015 |

Table 7 shows the relationship between the amount (Q) of MnS and the value of dS/dQ. The dS/dQ value is calculated based on a function which represents the fitting curve showing the relationship between the amount (Q) of MnS and the grain size number as shown in FIG. 2.

Referring to Tables 5 and 7, the differential coefficient (dS/dQ) is almost equal to 0 when MnS is equal to 2.0 (wt %). When the differential coefficient (dS/dQ) is at least about 0.2, the growth of the iron grain is effectively inhibited. Accordingly, preferably, the differential coefficient (dS/dQ) is at least about 0.2.

Further, when the iron grains in the iron powder have grain size number about 6.5 to about 7.6 according to "Methods of Ferrite Grain Size Test for Steel" of JIS G 0552 of 1977, a powder metallurgy product having improved machinability without substantially deteriorating fatigue strength may be obtained. Preferably, the iron grains in the iron powder have grain size number about 6.5 to about 7.5 according to the "Methods of Ferrite Grain Size Test for Steel" of JIS G 0552 of 1977.

Further, inventors examined the effect of forging. With respect to the samples A and B in Table 1 and Example 5 in Table 6, fatigue strength was measured before and after forging.

TABLE 8

| | Before Forging ($N/mm^2$) | After Forging ($N/mm^2$) | Improving Value ($N/mm^2$) | Improving Ratio (%) |
|---|---|---|---|---|
| Sample A | 187 | 343 | 156 | 83.4 |
| Sample B | 183 | 333 | 150 | 82.0 |
| Example 5 | 185 | 347 | 162 | 87.6 |

Table 8 shows fatigue strength of each sample before and after forging. Referring to Table 8, in sample B, improvement of fatigue strength by carrying out forging is minimum among the samples. In sample B, MnS particles exist on boundaries of iron particles. Accordingly, these MnS particles inhibit the improvement of fatigue strength by carrying out forging. On the other hand, in the Example 5, improvement of fatigue strength by carrying out forging is maximum among these samples. In sample C, MnS particles in the iron grains inhibit the growth of iron grain. Accordingly, the improvement of fatigue strength by carrying out forging increases. Therefore, fatigue strength further increases by forging the powder metallurgy product which if formed from pre-alloyed iron powder.

According to the embodiment of the present invention, machinability may improve without substantially deteriorating fatigue strength.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A powder metallurgy product which is made from constituent, the constituent comprising:

iron powder including iron grains which contain machinability improving element in the iron grains, the machinability improving element being configured to improve machinability of the powder metallurgy product and having a pinning effect, an amount (Q) of the machinability improving element being adjusted such that an absolute value of a differential coefficient (dS/dQ) is at least a predetermined value, where (S) is a grain size of iron in the powder metallurgy product.

2. A powder metallurgy product according to claim 1, wherein the machinability improving element comprises MnS.

3. A powder metallurgy product according to claim 2, wherein the iron powder contains MnS of 0.1 weight percent to 1.4 weight percent.

4. A powder metallurgy product according to claim 3, wherein the iron powder contain MnS of 0.1 weight percent to 1.0 weight percent.

5. A powder metallurgy product according to claim 2, wherein the iron grains in the powder metallurgy product have grain size number 6.5 to 7.6 according to "Methods of Ferrite Grain Size Test for Steel" of JIS (Japanese Industrial Standard) G 0552 of 1977.

6. A powder metallurgy product according to claim 5, wherein the iron grains in the powder metallurgy product have grain size number 6.5 to 7.5 according to the "Methods of Ferrite Grain Size Test for Steel" of JIS G 0552 of 1977.

7. A powder metallurgy product according to claim 2, wherein the absolute value of the differential coefficient (dS/dQ) is at least 0.2, where the grain size is represented by grain size number according to "Methods of Ferrite Grain Size Test for Steel" of JIS (Japanese Industrial Standard) G 0552 of 1977.

8. A powder metallurgy product according to claim 1, wherein the constituent is forged after being formed to a desired shape under pressure.

9. A method for producing a powder metallurgy product, comprising:

adding machinability improving element to iron grains of iron powder so as to contain machinability improving element in the iron grains, the machinability improving element being configured to improve machinability of the powder metallurgy product and having a pinning effect, an amount (Q) of the machinability improving element being adjusted such that an absolute value of a differential coefficient (dS/dQ) is at least a predetermined value, where (S) is a grain size of iron in the powder metallurgy product;

forming the iron powder to a pre-product under pressure; and sintering the pre-product.

10. A method according to claim 9, further comprising:

forging the sintered pre-product.

11. A method according to claim 9, wherein MnS is added as the machinability improving element.

12. A method according to claim 11, wherein the iron powder contains MnS of 0.1 weight percent to 1.4 weight percent.

13. A method according to claim 12, wherein the iron powder contains MnS of 0.1 weight percent to 1.0 weight percent.

14. A method according to claim 11, wherein the iron grains in the powder metallurgy product have grain size number 6.5 to 7.6 according to "Methods of Ferrite Grain Size Test for Steel" of JIS (Japanese Industrial Standard) G 0552 of 1977.

15. A method according to claim 14, wherein the iron grains in the powder metallurgy product have grain size number 6.5 to 7.5 according to the "Methods of Ferrite Grain Size Test for Steel" of JIS G 0552 of 1977.

16. A method according to claim 11, wherein the absolute value of the differential coefficient (dS/dQ) is at least 0.2, where the grain size is represented by grain size number according to "Methods of Ferrite Grain Size Test for Steel" of JIS (Japanese Industrial Standard) G 0552 of 1977.

17. A powder metallurgy product which is made from constituent, the constituent comprising:

iron powder including iron grains which contain MnS of 0.1 weight percent to 1.4 weight percent in the iron grains.

18. A powder metallurgy product according to claim 17, wherein the iron powder contains MnS of 0.1 weight percent to 1.0 weight percent.

19. A powder metallurgy product which is made from constituent, the constituent comprising:

iron powder including iron grains which contain machinability improving element in the iron grains, the machinability improving element being configured to improve machinability of the powder metallurgy product and having a pinning effect, an amount of the machinability improving element being adjusted to improve machinability without substantially deteriorating fatigue strength of the powder metallurgy product.

20. A powder metallurgy product according to claim 19, wherein the machinability improving element comprises MnS.

21. A powder metallurgy product according to claim 19, wherein the machinability improving element comprises BN.

22. A powder metallurgy product according to claim 19, wherein the machinability improving element comprises ceramic powder having a melting point higher than that of iron.

23. A powder metallurgy product according to claim 19, wherein the machinability improving element is substantially uniformly deposited in the iron grains.

* * * * *